US009754595B2

(12) United States Patent
Lee et al.

(10) Patent No.: US 9,754,595 B2
(45) Date of Patent: Sep. 5, 2017

(54) METHOD AND APPARATUS FOR ENCODING AND DECODING 3-DIMENSIONAL AUDIO SIGNAL

(75) Inventors: Young-woo Lee, Suwon-si (KR); Sun-min Kim, Yongin-si (KR); Hwan Shim, Yongin-si (KR); Nam-suk Lee, Suwon-si (KR); Hyun-wook Kim, Suwon-si (KR); Jong-hoon Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 829 days.

(21) Appl. No.: 13/493,406

(22) Filed: Jun. 11, 2012

(65) Prior Publication Data

US 2012/0314875 A1 Dec. 13, 2012

Related U.S. Application Data

(60) Provisional application No. 61/496,757, filed on Jun. 14, 2011, provisional application No. 61/495,047, filed on Jun. 9, 2011.

(30) Foreign Application Priority Data

Jun. 5, 2012 (KR) ..... 10-2012-0060523

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... H04S 2420/03; G10L 19/008
USPC ..... 381/22, 23, 1, 2; 704/500
See application file for complete search history.

(56) References Cited

U.S. PATENT DOCUMENTS

| | | | | |
|---|---|---|---|---|
| 9,257,128 | B2 | 2/2016 | Beack et al. | |
| 2010/0121647 | A1* | 5/2010 | Beack | G10L 19/008 704/500 |
| 2011/0200197 | A1* | 8/2011 | Kim | G10L 19/008 381/22 |

FOREIGN PATENT DOCUMENTS

| | | | |
|---|---|---|---|
| JP | 2010-525378 | A | 7/2010 |
| JP | 5238706 | B2 | 7/2013 |
| KR | 10-2009-0030323 | A | 3/2009 |
| KR | 10-2011-0002489 | A | 1/2011 |

OTHER PUBLICATIONS

Communication dated Jun. 26, 2017 issued by the Korean Intellectual Property Office in counterpart Korean Patent Application No. 10-2012-0060523.

* cited by examiner

*Primary Examiner* — Vivian Chin
*Assistant Examiner* — Ammar Hamid
(74) *Attorney, Agent, or Firm* — Sughrue Mion, PLLC

(57) ABSTRACT

A method of encoding a multi-channel 3-dimensional (3D) audio signal mixed with a multi-channel 3D object signal is provided. The method includes: obtaining a location parameter indicating a virtual location of the multi-channel 3D object signal on a multi-channel speaker layout based on a gain value of the multi-channel 3D object signal for each channel; and encoding the multi-channel 3D audio signal and the location parameter.

4 Claims, 10 Drawing Sheets

METHOD AND APPARATUS FOR ENCODING AND DECODING 3-DIMENSIONAL AUDIO SIGNAL

CROSS-REFERENCE TO RELATED PATENT APPLICATION

This application claims priority from U.S. Patent Provisional Application Nos. 61/495,047, filed on Jun. 9, 2011 and 61/496,757, filed on Jun. 14, 2011, in the U.S. Patent Trademark Office, and Korean Patent Application No. 10-2012-0060523, filed on Jun. 5, 2012, in the Korean Intellectual Property Office the disclosures of which are incorporated herein in their entirety by reference.

BACKGROUND

1. Field

Apparatuses and methods consistent with the exemplary embodiments relate to encoding and decoding a 3-dimensional (3D) audio signal, and more particularly, to encoding and decoding a 3D audio signal while maintaining a cubic effect applied to the 3D audio signal.

2. Description of the Related Art

Recently, because of a market growth of 3-dimensional (3D) images, there has been an increase in the demand for 3D audio. 3D audio provides listeners with a realistic sense that the listeners are in a place where corresponding audio is generated.

3D audio may be artificially generated by engineers. More specifically, engineers may generate a 3D audio signal by selecting an object to which a cubic effect is to be applied from a plurality of objects and panning the selected object into a multi-channel to apply a 3D effect thereto, and mixing the object panned into the multi-channel with other objects.

Various technologies which maintain a cubic effect applied to an audio signal that is encoded or decoded have been proposed. However, in a case where a 5.1 channel 3D audio signal is encoded and decoded and then reproduced via a channel speaker other than a 5.1 channel speaker, such related art technologies are problematic since a cubic effect of the 3D audio signal is not precisely maintained.

SUMMARY

The exemplary embodiments provide a method and apparatus for encoding and decoding a 3-dimensional (3D) audio signal, which precisely maintain a cubic effect applied to the 3D audio signal.

According to an aspect of the exemplary embodiments, there is provided a method of encoding a multi-channel 3D audio signal mixed with a multi-channel 3D object signal, the method including: obtaining a location parameter indicating a virtual location of the multi-channel 3D object signal on a multi-channel speaker layout based on a gain value of the multi-channel 3D object signal for each channel; and encoding the multi-channel 3D audio signal and the location parameter.

The method may further include: obtaining a spatial parameter indicating a correlation between the multi-channel 3D audio signal and the multi-channel 3D object signal, wherein the encoding includes: encoding the spatial parameter.

The encoding may include: generating a first bitstream including the multi-channel 3D audio signal and a second bitstream including the location parameter.

The encoding may include: generating a third bitstream including the spatial parameter.

The method may further include: obtaining a channel parameter indicating correlations between channels of the multi-channel 3D audio signal, wherein the encoding includes: generating a fourth bitstream including the channel parameter.

The method may further include: selecting at least one of a plurality of object signals as the multi-channel 3D object signal based on a user input; and generating the multi-channel 3D audio signal by mixing a first multi-channel layer signal panned with the object signals excluding the at least one selected object signal from the plurality of object signals and a second multi-channel layer signal panned with the at least one selected object signal.

The obtaining of the location parameter may include: extracting a gain value of the multi-channel 3D object signal for each channel.

The method may further include: determining the object signal simultaneously panned into a front channel and a surround channel of the multi-channel among the plurality of object signals as the multi-channel 3D object signal.

The location parameter may include at least one of a distance and an azimuth between a center point on the multi-channel speaker layout and the multi-channel 3D object signal.

In a case where the multi-channel includes a height speaker channel, the location parameter may further include an elevation angle between a horizontal plane of the multi-channel speaker layout and the multi-channel 3D object signal.

In a case where the multi-channel includes a horizontal plane speaker channel, and a height value is set so that the multi-channel 3D object signal is output at a predetermined height from the horizontal plane of the multi-channel speaker layout, the location parameter may include the height value.

The location parameter may include an index value indicating the distance between the center point on the multi-channel speaker layout and the multi-channel 3D object signal.

The location parameter may be presented as a gerzon vector.

The location parameter may present the virtual location of the multi-channel 3D object signal on the multi-channel speaker layout, or the virtual location and a virtual location range.

The obtaining of the location parameter may include: obtaining a reference virtual location of the multi-channel 3D object signal; and obtaining location parameters with respect to signals having virtual locations different from the reference virtual location among signals included in the multi-channel 3D object signal.

The location parameter may include a difference between the virtual locations of the signals and the reference virtual location.

According to another aspect of the exemplary embodiments, there is provided a method of decoding a 3D audio signal performed by a decoding apparatus, the method including: receiving a first bitstream including a first multi-channel 3D audio signal mixed with the first multi-channel 3D object signal and a second bitstream including a location parameter indicating a virtual location of the first multi-channel 3D object signal on a first multi-channel speaker layout; decoding the first multi-channel 3D audio signal and the location parameter included in the first bitstream and the second bitstream, respectively; and modifying and outputting the first multi-channel 3D audio signal based on the location parameter.

The method may further include: receiving a third bitstream including a spatial parameter indicating a correlation between the first multi-channel 3D audio signal and the first multi-channel 3D object signal and decoding the spatial parameter included in the third bitstream, wherein the modifying and outputting the first multi-channel 3D object signal includes: extracting the first multi-channel 3D object signal from the first multi-channel 3D audio signal by using the spatial parameter; and mixing and outputting the first multi-channel 3D object signal and the first multi-channel 3D audio signal based on the location parameter.

The first bitstream may include the down-mixed 3D audio signal, the method further including: receiving a fourth bitstream including a channel parameter indicating correlations between channels of the first multi-channel 3D audio signal and decoding the channel parameter included in the fourth bitstream; and obtaining the first multi-channel 3D audio signal by applying the channel parameter to down-mixed first multi-channel 3D audio signal.

The mixing and outputting of the first multi-channel 3D object signal and the first multi-channel 3D audio signal may include: in a case where the decoding apparatus includes a second multi-channel speaker layout different from the first multi-channel speaker layout, resetting a gain value of the first multi-channel 3D object signal for each channel according to the second multi-channel speaker layout based on the location parameter.

The mixing and outputting the first multi-channel 3D object signal and the first multi-channel 3D audio signal may include: receiving a virtual location of the first multi-channel 3D object signal or the gain value of the first multi-channel 3D object signal for each channel from a user; and resetting the gain value of the first multi-channel 3D object signal for each channel with respect to the second multi-channel speaker layout according to the virtual location of the first multi-channel 3D object signal or the gain value of the first multi-channel 3D object signal for each channel received from the user.

According to another aspect of the exemplary embodiments, there is provided an apparatus for encoding a multi-channel 3D audio signal mixed with a multi-channel 3D object signal, the apparatus including: a first parameter obtainer for obtaining a location parameter indicating a virtual location of the multi-channel 3D object signal on a multi-channel speaker layout based on a gain value of the multi-channel 3D object signal for each channel; and an encoder for encoding the multi-channel 3D audio signal and the location parameter.

The apparatus may further include: a second parameter obtainer for obtaining a spatial parameter indicating a correlation between the multi-channel 3D audio signal and the multi-channel 3D object signal, wherein the encoder encodes the spatial parameter.

The encoder may generate a first bitstream including the multi-channel 3D audio signal and a second bitstream including the location parameter.

The encoder may generate a third bitstream including the spatial parameter.

The apparatus may further include: a third parameter obtainer for obtaining a channel parameter indicating correlations between channels of the multi-channel 3D audio signal, wherein the encoder generates a fourth bitstream including the channel parameter.

The encoder may further include: a selector for selecting at least one of a plurality of object signals as the multi-channel 3D object signal based on a user input; and a generator for generating the multi-channel 3D audio signal by mixing a first multi-channel layer signal panned with the object signals excluding the at least one selected object signal from the plurality of object signals and a second multi-channel layer signal panned with the at least one selected object signal.

The first parameter obtainer may extract a gain value of the multi-channel 3D object signal for each channel.

The apparatus may further include: a determiner for determining the object signal simultaneously panned into a front channel and a surround channel of the multi-channel among the plurality of object signals as the multi-channel 3D object signal.

The location parameter may include at least one of a distance and an azimuth between a center point on the multi-channel speaker layout and the multi-channel 3D object signal.

In a case where the multi-channel includes a height speaker channel, the location parameter may further include an elevation angle between a horizontal plane of the multi-channel speaker layout and the multi-channel 3D object signal.

In a case where the multi-channel includes a horizontal plane speaker channel, and a height value is set so that the multi-channel 3D object signal is output at a predetermined height from the horizontal plane of the multi-channel speaker layout, the location parameter may include the height value.

The location parameter may include an index value indicating the distance between the center point on the multi-channel speaker layout and the multi-channel 3D object signal.

The first parameter obtainer may present the location parameter as a gerzon vector.

The location parameter may present the virtual location of the multi-channel 3D object signal on the multi-channel speaker layout, or the virtual location and a virtual location range.

The first parameter obtainer may obtain a reference virtual location of the multi-channel 3D object signal, and obtain location parameters with respect to signals having virtual locations different from the reference virtual location among signals included in the multi-channel 3D object signal.

The location parameter may include a difference between the virtual locations of the signals and the reference virtual location.

According to another aspect of the exemplary embodiments, there is provided a decoding apparatus including: a receiver for receiving a first bitstream including a first multi-channel 3D audio signal mixed with the first multi-channel 3D object signal and a second bitstream including a location parameter indicating a virtual location of the first multi-channel 3D object signal on a first multi-channel speaker layout; a decoder for decoding the first multi-channel 3D audio signal and the location parameter included in the first bitstream and the second bitstream, respectively; and a renderer for modifying and outputting the first multi-channel 3D audio signal based on the location parameter.

The receiver may receive a third bitstream including a spatial parameter indicating a correlation between the first multi-channel 3D audio signal and the first multi-channel 3D object signal, the method further including: an extracter for extracting the first multi-channel 3D object signal from the first multi-channel 3D audio signal by using the spatial parameter that is included in the third bitstream and is decoded, wherein the renderer mixes and outputs the first multi-channel 3D object signal and the first multi-channel 3D audio signal based on the location parameter.

In a case where the decoding apparatus includes a second multi-channel speaker other than the first multi-channel, the renderer may reset a gain value of the first multi-channel 3D object signal for each channel according to the second multi-channel speaker based on the location parameter.

The renderer may reset the gain value of the first multi-channel 3D object signal for each channel with respect to the second multi-channel speaker according to a virtual location of the first multi-channel 3D object signal or a gain value of the first multi-channel 3D object signal for each channel received from a user.

The first bitstream may include the down-mixed first multi-channel 3D audio signal, wherein the receiver receives a fourth bitstream including a channel parameter indicating correlations between channels of the first multi-channel 3D audio signal, wherein the decoder obtains the first multi-channel 3D audio signal by applying the channel parameter that is decoded from the fourth bitstream to the down-mixed first multi-channel 3D audio signal.

According to another aspect of the exemplary embodiments, there is provided a computer readable recording medium having recorded thereon a program for executing the method of encoding a multi-channel 3D audio signal mixed with a multi-channel 3D object signal.

According to another aspect of the exemplary embodiments, there is provided a computer readable recording medium having recorded thereon a program for executing the method of decoding a 3D audio signal performed by a decoding apparatus.

BRIEF DESCRIPTION OF THE DRAWINGS

The above and other aspects will become more apparent by describing in detail exemplary embodiments thereof with reference to the attached drawings in which.

DETAILED DESCRIPTION OF THE EXEMPLARY EMBODIMENTS

Figure 1:
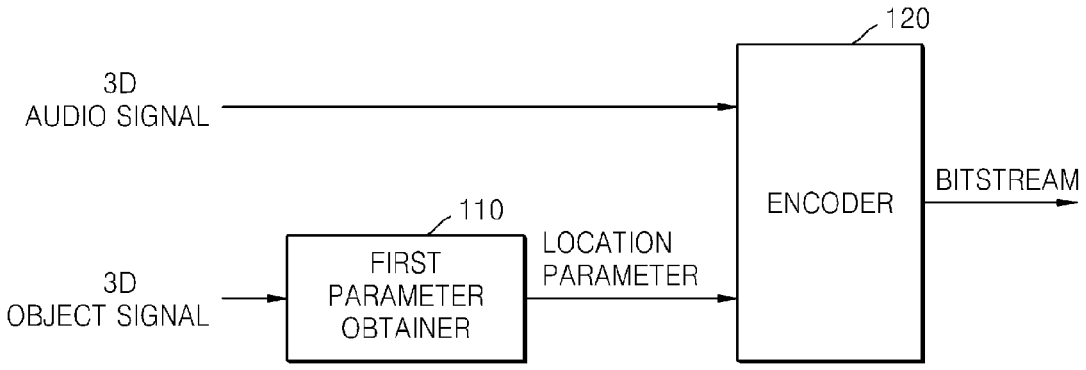
FIG. 1 is a block diagram of an encoding apparatus according to an exemplary embodiment.

Hereinafter, the application will be described more fully with reference to the accompanying drawings, in which exemplary embodiments are shown. The exemplary embodiments may, however, be embodied in many different forms and should not be construed as being limited to the exemplary embodiments set forth herein; rather, these exemplary embodiments are provided so that this disclosure will be thorough and complete, and will fully convey the concept of the exemplary embodiments to those of ordinary skill in the art. Like reference numerals in the drawings denote like elements, and thus their description will be omitted.

As used herein, the term 'unit' refers to components of software or hardware such as a field-programmable gate array (FPGA) or an application specific integrated circuit (ASIC) and a 'unit' performs a particular function. However, the term 'unit' is not limited to software or hardware. A 'unit' may be configured to be included in a storage medium to be addressed or to reproduce one or more processors. Thus, examples of a 'unit' include components such as components of object-oriented software, class components, and task components, processes, functions, attributes, procedures, subroutines, segments of program codes, drives, firmware, a microcode, circuit, data, a database, data structures, tables, arrays, and parameters. Functions provided by components and 'units' may be performed by combining a smaller number of components and 'units' or further separating additional components and 'units' therefrom.

Expressions such as "at least one of" when preceding a list of elements modify the entire list of elements and do not modify the individual elements of the list.

In the present specification, a 3-dimensional (3D) audio signal and a 3D object signal may include a down-mixed 3D audio signal and a down-mixed 3D object signal.

FIG. 1 is a block diagram of an encoding apparatus according to an exemplary embodiment. Referring to FIG. 1, the encoding apparatus according to an exemplary embodiment may include a first parameter obtainer 110 and an encoder 120.

The first parameter obtainer 110 may receive a multi-channel 3D object signal. The multi-channel 3D object signal may be stored in a memory (not shown) of the encoding apparatus.

The multi-channel 3D object signal may be a signal that is panned into a multi-channel such as a 5.1 channel, a 7.1 channel, etc. The multi-channel 3D audio signal may be a signal that is panned into the same channel as that of the multi-channel 3D object signal and that is mixed with the multi-channel 3D object signal.

The first parameter obtainer 110 may extract a gain value of the multi-channel 3D object signal for each channel. The first parameter obtainer 110 may receive the extracted gain value of the multi-channel 3D object signal for each channel from an external element.

The first parameter obtainer 110 obtains a location parameter indicating a virtual location of the multi-channel 3D object signal on a multi-channel speaker layout based on the extracted gain value of the multi-channel 3D object signal for each channel. For example, in a case where the multi-channel 3D object signal is a 5.1 channel signal, the first parameter obtainer 110 obtains the location parameter indicating a virtual location of a panned multi-channel 3D object signal on a speaker layout including a front center (FC) channel, a front left (FL) channel, a front right (FR) channel, a surround left (SL) channel, and a surround right (SR)

channel. The location parameter will be described in more detail with reference to FIG. 5 later.

Figure 3A:
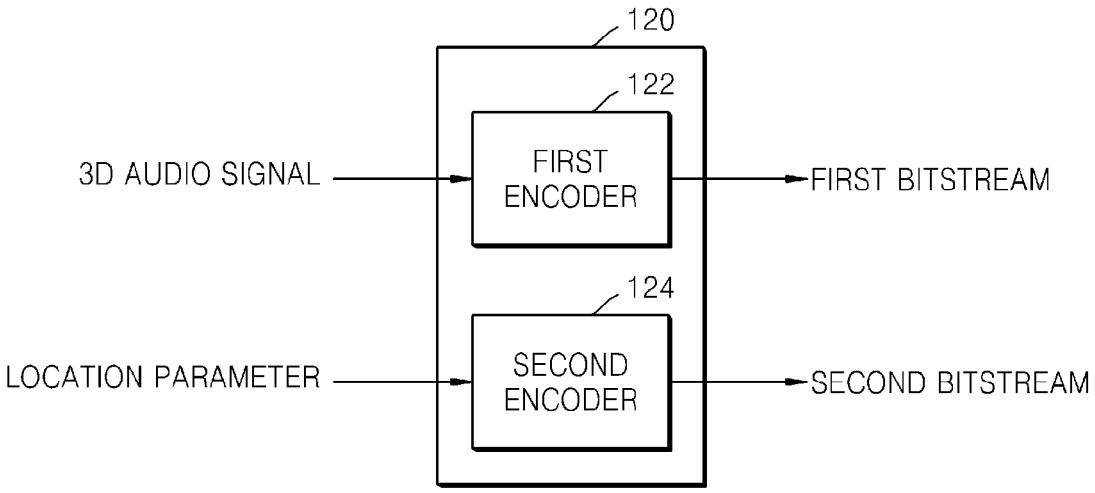
FIGS. 3A and 3B are block diagrams of an encoder of an encoding apparatus according to other exemplary embodiments.

The encoder 120 encodes the multi-channel 3D audio signal and the location parameter. FIG. 3A is a block diagram of the encoder 120 of the encoding apparatus according to an exemplary embodiment. A first encoder 122 may encode the 3D audio signal to generate a first bitstream. A second encoder 124 may encode the location parameter to generate a second bitstream.

Also, the first encoder 122 may encode a down-mixed multi-channel 3D audio signal by using a waveform encoding method (for example, AAC, AC3, MP3 or OGG) and a parametric sinusoidal coding method.

As will be described later, a decoding apparatus may precisely maintain a cubic effect applied to the multi-channel 3D audio signal by using the location parameter.

Figure 2:
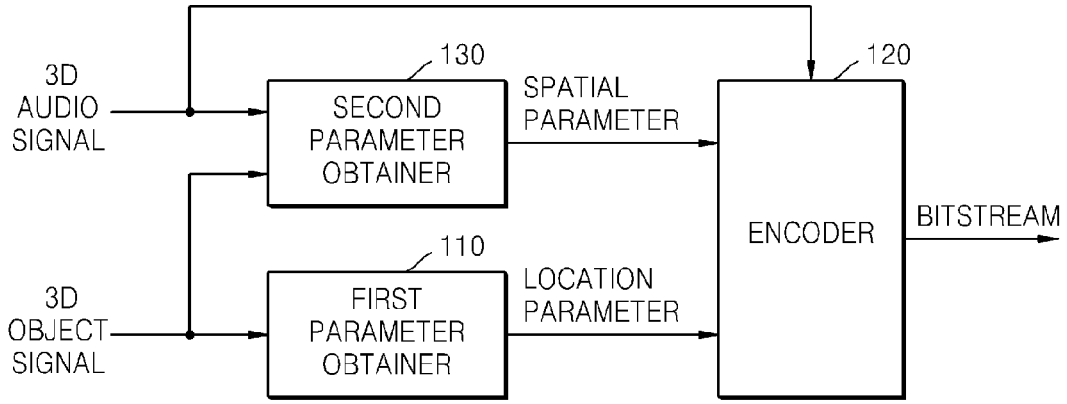
FIG. 2 is a block diagram of an encoding apparatus according to another exemplary embodiment.

FIG. 2 is a block diagram of an encoding apparatus according to another exemplary embodiment. The encoding apparatus of FIG. 2 may further include a second parameter obtainer 130 compared to the encoding apparatus of FIG. 1. Although the first parameter obtainer 110 and the second parameter obtainer 130 are physically separated from each other in FIG. 2, it will be obvious to one of ordinary skill in the art that the first parameter obtainer 110 and the second parameter obtainer 130 may be configured as a single module.

The second parameter obtainer 130 obtains a spatial parameter indicating a correlation between a 3D audio signal and a 3D object signal. The spatial parameter is a parameter used to separate the 3D object signal from the 3D audio signal, such as a parameter used for a channel separation in the MPEG surround and a parameter used for an object signal separation in the spatial audio object coding (SAOC). The spatial parameter may include at least one of an object level difference (OLD), absolute object energy (NRG), an inter-object cross-correlation (IOC), a down-mix gain (DMG), and a down-mix channel level difference (DCLD).

The second parameter obtainer 130 may obtain the spatial parameter from a down-mixed 3D audio signal and a down-mixed 3D object signal.

The encoding apparatus according to the exemplary embodiment may further include a third parameter obtainer (not shown) that obtains a channel parameter indicating correlations between channels of a 3D object signal from the 3D object signal of a multi-channel. The channel parameter is widely used in the MPEG surround technology, and thus its detailed description is omitted here.

Figure 3B:
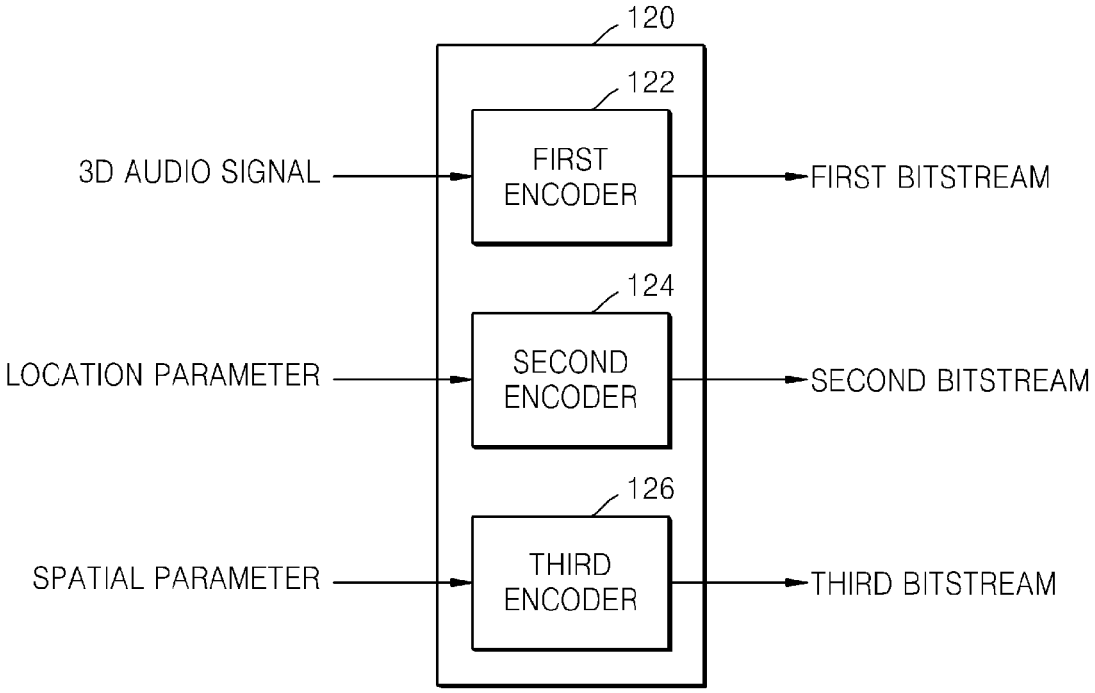

The encoder 120 may encode the 3D audio signal, the location parameter, and the spatial parameter to generate bitstreams. FIG. 3B is a block diagram of the encoder 120 of the encoding apparatus according to another exemplary embodiment. The encoder 120 may include the first encoder 122, the second encoder 124 and a third encoder 126.

The first encoder 122 encodes a 3D audio signal to generate a first bitstream including the 3D audio signal. The first bitstream may include a down-mixed 3D audio signal. The second encoder 124 encodes a location parameter to generate a second bitstream including the location parameter. The third encoder 126 encodes a spatial parameter to generate a third bitstream including the spatial parameter. In a case where the encoding apparatus according to another exemplary embodiment obtains the channel parameter from the 3D audio signal, the encoder 120 may further comprise a fourth encoder (not shown) to generate a fourth bitstream including the channel parameter.

It will be obvious to one of ordinary skill in the art that the first bitstream, the second bitstream and the third bitstream of FIGS. 3A and 3B may be combined with each other and may be divided into a greater number of bitstreams.

Figure 4:
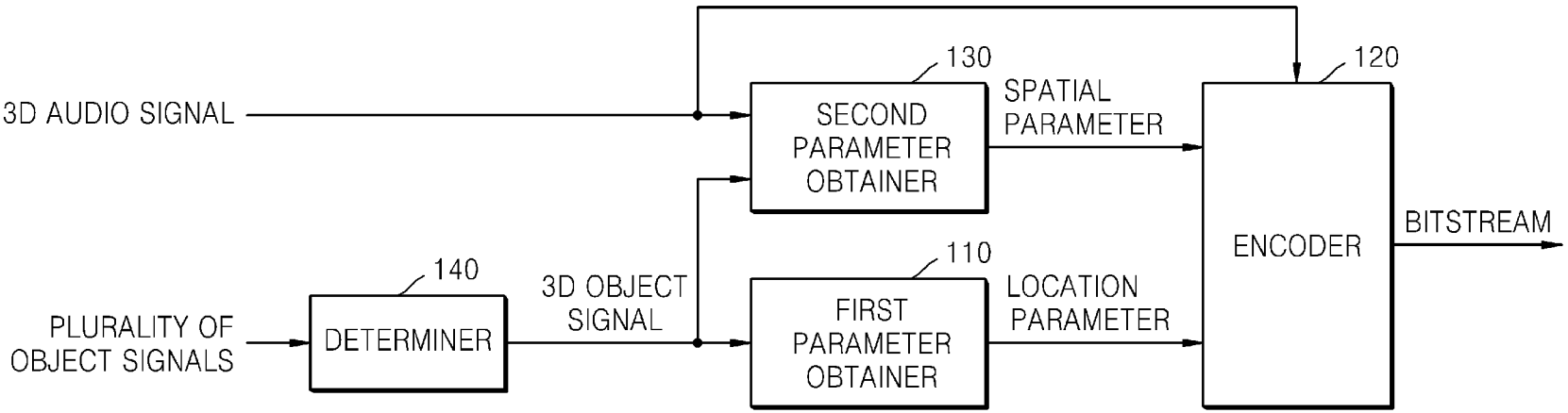
FIG. 4 is a block diagram of an encoding apparatus according to another exemplary embodiment.

FIG. 4 is a block diagram of an encoding apparatus according to another exemplary embodiment. The encoding apparatus of FIG. 4 may further include a determiner 140. Although a 3D object signal is not specified, the encoding apparatus of FIG. 4 may determine the 3D object signal from a plurality of object signals.

The determiner 140 receives the plurality of object signals mixed with the 3D object signal. The determiner 140 may obtain a gain value of each of the object signals for each channel, and determine the 3D object signal based on the gain value for each channel.

In general, since a 3D object signal is simultaneously panned into a front channel and a surround channel of a multi-channel, the determiner 140 may determine an object signal that is simultaneously panned into the front channel and the surround channel as the 3D object signal.

The first parameter obtainer 110 may receive the 3D object signal from the determiner 140, and obtain a location parameter based on a gain value of the 3D object signal for each channel. Also, in case the determiner 140 already extracted the gain value of the 3D object signal for each channel, the first parameter obtainer 110 may receive the gain value of the 3D object signal for each channel from the determiner 140 to obtain the location parameter.

The second parameter obtainer 130 receives the 3D object signal from the determiner 140, and obtains a spatial parameter by using a 3D audio signal and the 3D object signal.

Figure 5:
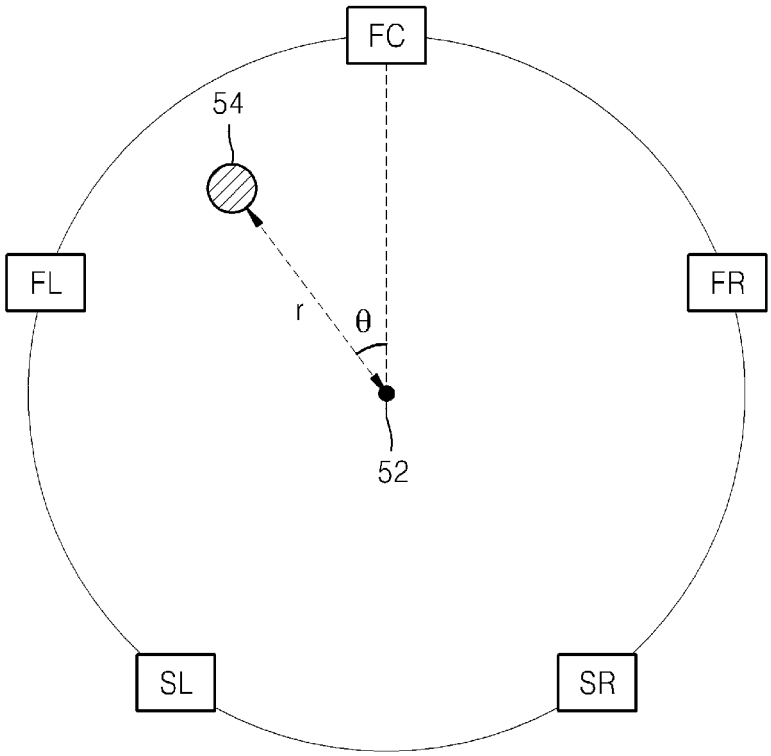
FIG. 5 illustrates a virtual location of a 3D object signal on a multi-channel speaker layout.

FIG. 5 illustrates a virtual location of a 3D object signal 54 on a multi-channel speaker layout. Although a 5.1 channel is applied to the multi-channel speaker layout in FIG. 5, it will be obvious to one of ordinary skill in the art that various channels, other than the 5.1 channel, may also be applied thereto.

Referring to FIG. 5, the 5.1 channel includes an FC channel, an FL channel, an FR channel, an SL channel, and an SR channel.

If an object signal is panned into each of multi-channels by differentiating a gain of the object signal, a listener (who is assumed to be in the center of the multi-channel speaker layout) may feel that the 3D object signal 54 is output from a predetermined location of the multi-channel speaker layout.

The first parameter obtainer 110 may obtain the virtual location of the 3D object signal 54 on the multi-channel speaker layout based on a gain value of a 3D object signal for each channel, and obtain the obtained virtual location as a location parameter.

The first parameter obtainer 110 may present the virtual location of the 3D object signal 54 as a location of the listener, i.e., at least one of a distance r and an azimuth θ between a center point 52 and the 3D object signal 54 on the multi-channel speaker layout. Also, the first parameter obtainer 110 may present the virtual location of the 3D object signal 54 and a virtual location range (a variance, a standard deviation, a range of a sound image, etc.) as the location parameter since a decoding end for rendering a multi-channel 3D audio signal is configured as a channel speaker other than the multi-channel panned with the 3D audio signal, the decoding end is unable to precisely achieve a virtual location of the multi-channel 3D object signal on a multi-channel speaker layout in a channel speaker layout other than the multi-channel speaker layout.

The first parameter obtainer 110 may present the distance r between the center point 52 and the 3D object signal 54 on the multi-channel speaker layout as a predetermined index value. That is, the first parameter obtainer 110 presents the distance r between the center point 52 and the 3D object signal 54 on the multi-channel speaker layout as a previously set index value, thereby reducing a bit rate of the location parameter.

In a case where a multi-channel into which the 3D object signal 54 is panned includes a height speaker channel, the first parameter obtainer 110 may present an elevation angle between a horizontal plane of the multi-channel speaker layout and the 3D object signal 54 as the location parameter.

Meanwhile, in a case where the 3D object signal 54 is panned into a multi-channel including a horizontal plane speaker, an engineer may set a height value in such a way that the 3D object signal 54 may be output at a predetermined height from the horizontal plane of the multi-channel speaker layout. In this case, the first parameter obtainer 110 may extract the height value set by the engineer from the 3D object signal 54 or additional data to allow the height value to be further included in the location parameter.

The first parameter obtainer 110 may present the location parameter as a gerzon vector that is generally used to present a location of a virtual sound source synthesized in a 3D audio signal.

Meanwhile, the first parameter obtainer 110 may obtain location parameters of signals classified as predetermined frequency bands included in the 3D audio signal and obtain a reference virtual location of the 3D object signal 54 Then, the first parameter obtainer 110 may obtain location parameters with respect to signals having virtual locations different from the reference virtual location among signals included in the 3D object signal 54. More specifically, the first parameter obtainer 110 may obtain virtual locations of the signals included in the 3D object signal 54, calculate a mean of the obtained virtual locations, and obtain the reference virtual location of the 3D object signal 54. The first parameter obtainer 110 may obtain the location parameters with respect to the signals having virtual locations different from the reference virtual location among the signals included in the 3D object signal 54. In this case, the location parameters may include a difference between the virtual location of the signals and the reference virtual location of the 3D object signal. The encoding apparatus according to another exemplary embodiment may transmit the location parameter including the difference between the virtual location of the signals and reference virtual location of the 3D object signal, thereby bit rates of the location parameters may be reduced.

Also, when the 3D object signal is split into a plurality of frames in predetermined time units, the first parameter obtainer 110 may obtain reference virtual locations of the 3D object signal per frame. In this case, the location parameters with respect to the signals having virtual locations different from the reference virtual point of a predetermined frame among the signals included in the predetermined frame are obtained.

Figure 6:
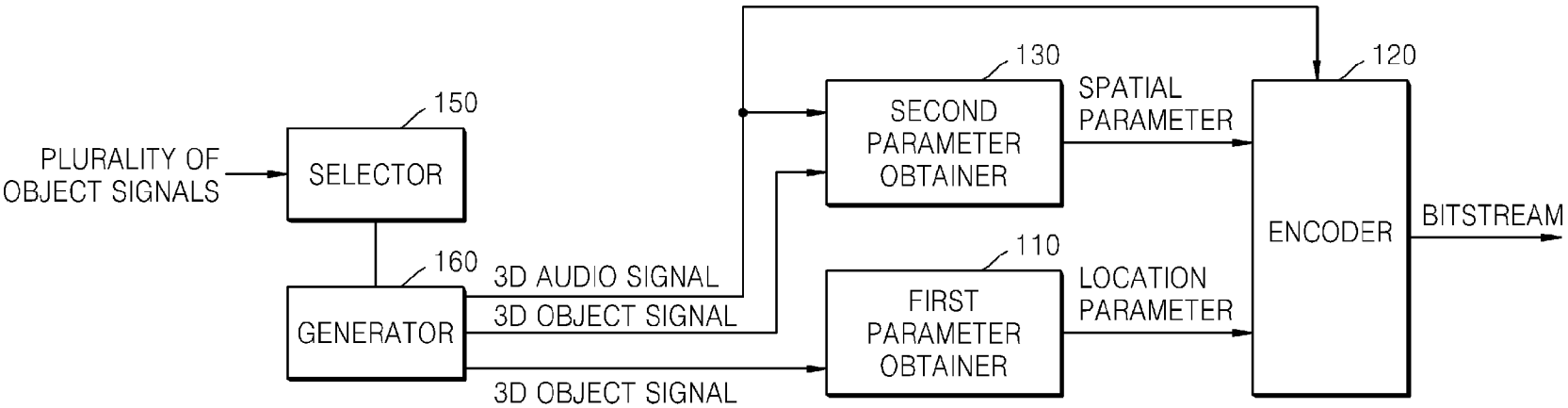
FIG. 6 is a block diagram of an encoding apparatus according to another exemplary embodiment.

FIG. 6 is a block diagram of an encoding apparatus according to another exemplary embodiment. The encoding apparatus of FIG. 6 may provide a user with a mixing function.

Referring to FIG. 6, the encoding apparatus may further include a selector 150 and a generator 160.

The selector 150 selects at least one of a plurality of object signals as a 3D object signal based on a user input. That is, the user may select an object signal to which a 3D effect is to be applied from the plurality of object signals that will be mixed with an audio signal.

The object signals excluding the object signal that is selected as the 3D object signal from among the plurality of object signals may pan into a first multi-channel layer and the object signal that is selected as the 3D object signal may pan into a second multi-channel layer. The multi-channel layer means a layer of multi-channels to be panned with an audio signal or an object signal When one object signal from among the plurality of object signals is selected by the user, the selected one object signal may be panned into the second multi-channel layer. Also, when two object signals from among the plurality of object signals are selected by the user, the selected two object signals may be panned together into the second multi-channel layer to generate a single second multi-channel layer signal, or the selected two object signals may be panned into two different second multi-channel layers to generate two different second multi-channel layer signals respectively.

The generator 160 mixes a first multi-channel layer signal panned with the object signals excluding the at least one selected object signal from the plurality of object signals and a second multi-channel layer signal panned with the at least one selected object signal to generate a 3D audio signal. Also, the generator 160 may extract a gain value of the 3D object signal for each channel when the 3D object signal is panned into the second multi-channel layer.

The generator 160 may transmit the 3D audio signal and the 3D object signal to the second parameter obtainer 130, and transmit the 3D object signal to the first parameter obtainer 110. In a case where the generator 160 extracts the gain value of the 3D object signal for each channel, the generator 160 may transmit the gain value of the 3D object signal for each channel to the first parameter obtainer 110.

The first parameter obtainer 110, the encoder 120, and the second parameter obtainer 130 are described with reference to FIGS. 1 and 2, and thus detailed descriptions thereof are omitted here.

Figure 7:
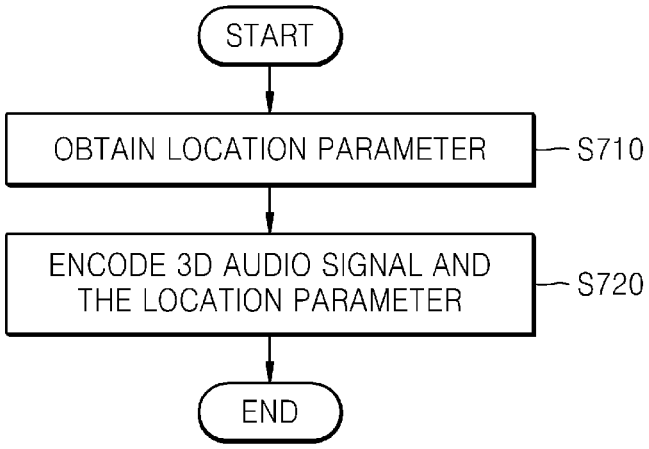
FIG. 7 is a flowchart of an encoding method according to an exemplary embodiment.

FIG. 7 is a flowchart of an encoding method according to an exemplary embodiment. Referring to FIG. 7, the encoding method according to an exemplary embodiment includes operations that are sequentially performed by the encoding apparatus of FIG. 1. Thus, although omitted below, the detailed description of the encoding apparatus of FIG. 1 may be applied to the encoding method of FIG. 7.

In operation S710, the encoding apparatus obtains a location parameter indicating a virtual location of a multi-channel 3D object signal on a multi-channel speaker layout based on a gain value of the multi-channel 3D object signal for each channel.

In operation S720, the encoding apparatus encodes a 3D audio signal and the location parameter.

Figure 8:
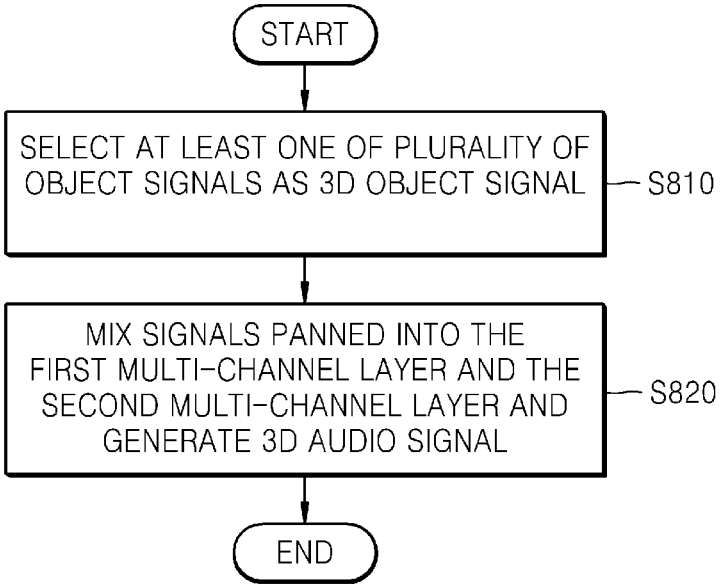
FIG. 8 is a flowchart of a method of generating a 3D audio signal according to an exemplary embodiment.

FIG. 8 is a flowchart of a method of generating a 3D audio signal according to an exemplary embodiment.

In operation S810, an encoding apparatus selects at least one of a plurality of object signals as a 3D object signal based on a user input.

When the object signals excluding the at least one 3D object signal selected from among the plurality of object signals are panned into the first multi-channel layer and the at least one selected 3D object signal is panned into the second multi-channel layer, in operation S820, the encoding apparatus mixes the signals panned into the first multi-channel layer and the second multi-channel layer to generate a 3D audio signal.

Figure 9:
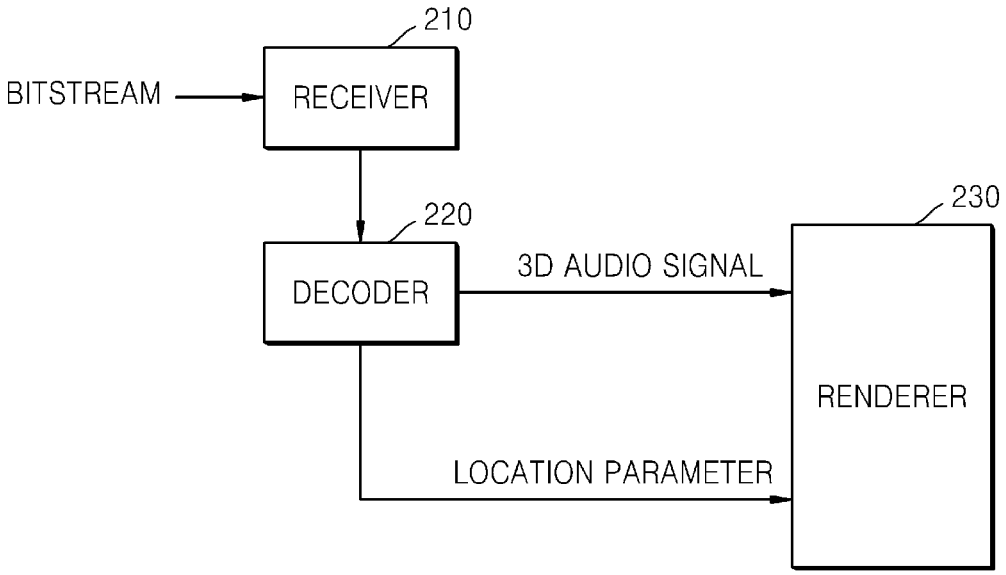
FIG. 9 is a block diagram of a decoding apparatus according to an exemplary embodiment.

FIG. 9 is a block diagram of a decoding apparatus according to an exemplary embodiment. Referring to FIG. 9, the decoding apparatus according to an exemplary embodiment may further include a receiver 210, a decoder 220, and a renderer 230.

The receiver 210 receives a first bitstream including a first multi-channel 3D audio signal mixed with the first multi-channel 3D object signal, and a second bitstream including a location parameter indicating a virtual location of the 3D object signal on the first multi-channel speaker layout. It is obvious to one of ordinary skill in the art that the first bitstream and the second bitstream may be configured as a single bitstream.

Figure 11A:
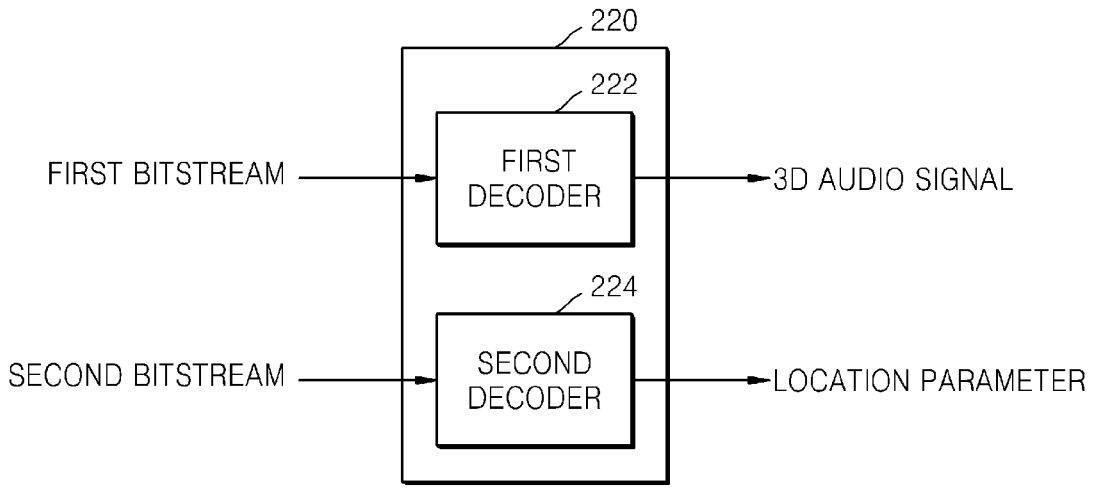
FIGS. 11A and 11B are block diagrams of a decoder of a decoding apparatus according to other exemplary embodiments.

The decoder 220 decodes the 3D audio signal and the location parameter included in the first bitstream and the second bitstream. FIG. 11A is a block diagram of the decoder 220 of a decoding apparatus according to an exemplary embodiment. In a case where the receiver 210 receives a first bitstream including a 3D audio signal and a second bitstream including a location parameter, a first decoder 222 may decode the first bitstream to output the 3D audio signal, and a second decoder 224 may decode the second bitstream to output the location parameter.

The renderer 230 modifies and outputs the 3D audio signal based on the location parameter received from the decoder 220. More specifically, the renderer 230 may predict the 3D object signal mixed with the 3D audio signal by using the location parameter, and adjust a gain value of the predicted 3D object signal for each channel to output the 3D object signal.

Meanwhile, the decoding apparatus according to an exemplary embodiment may output the 3D audio signal without using the location parameter, and thus the decoding apparatus has backward compatibility.

Figure 10:
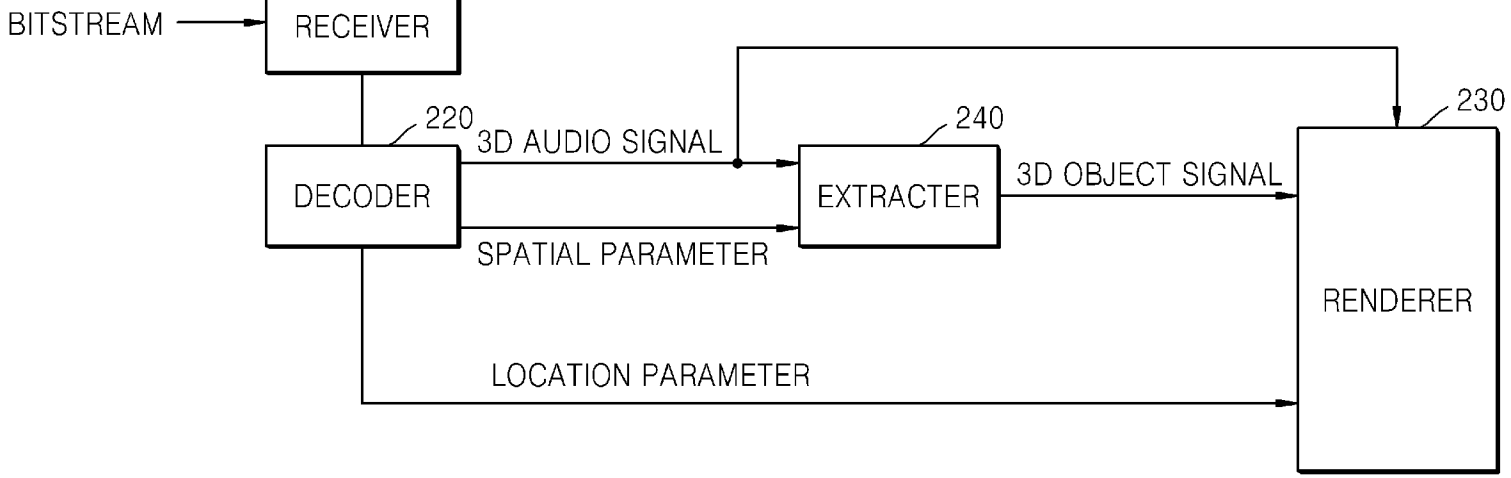
FIG. 10 is a block diagram of a decoding apparatus according to another exemplary embodiment.

FIG. 10 is a block diagram of a decoding apparatus according to another exemplary embodiment. The decoding apparatus according to another exemplary embodiment may further include an extracter 240. The decoding apparatus of FIG. 10 further receives a spatial parameter compared to the decoding apparatus of FIG. 9, and may easily separate a 3D object signal from a 3D audio signal by using the spatial parameter.

The receiver 210 further receives a third bitstream including the spatial parameter indicating a correlation between a first multi-channel 3D object signal and the 3D audio signal. Also, the receiver 210 may receive a fourth bitstream including a channel parameter indicating correlations between channels of a multi-channel 3D audio signal.

The decoder 220 decodes the spatial parameter included in the third bitstream.

In a case where the receiver 210 receives the fourth bitstream including the channel parameter, the decoder 220 decodes the channel parameter included in the fourth bitstream and obtains the multi-channel 3D audio signal by applying the channel parameter to down-mixed multi-channel 3D audio signal.

Figure 11B:
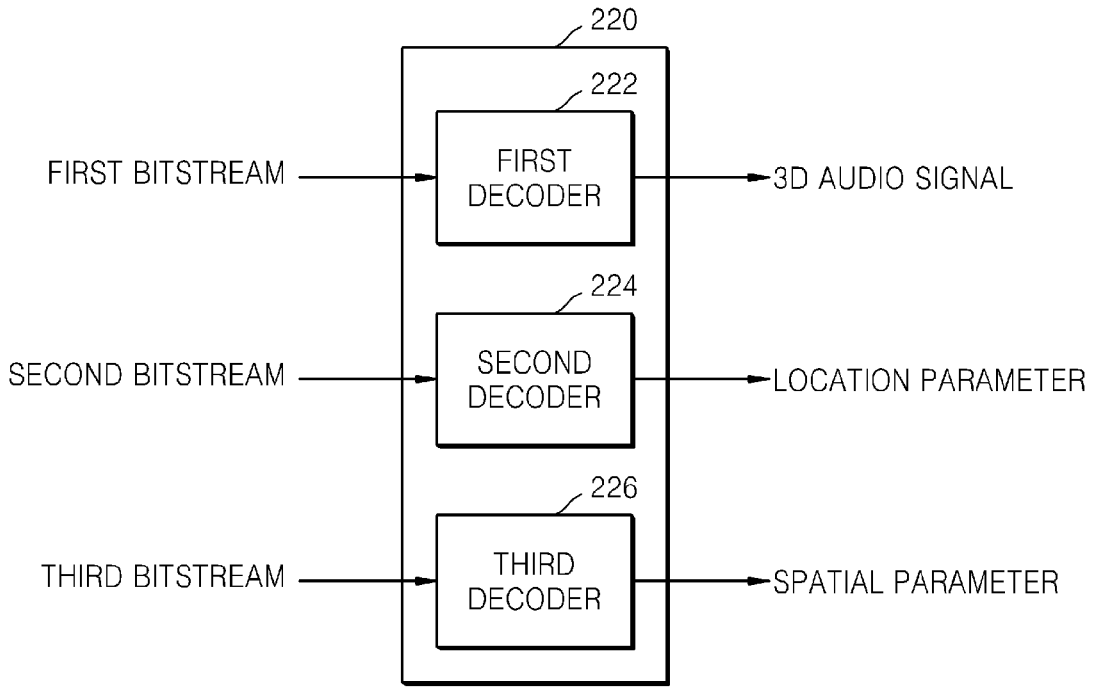

FIG. 11B is a block diagram of the decoder 220 of a decoding apparatus according to another exemplary embodiment. In a case where the receiver 210 receives a first bitstream including a 3D audio signal, a second bitstream including a location parameter and a third bitstream including a spatial parameter, the first decoder 222 of the decoder 220 decodes the first bitstream to output the 3D audio signal, and the second decoder 224 thereof decodes the second bitstream to output the location parameter. Also, a third decoder 226 decodes the third bitstream to output the spatial parameter. In a case where the receiver 210 receives the fourth bitstream including the channel parameter, the decoder 220 may further comprise a fourth decoder (not shown) to output the channel parameter by decoding the fourth bitstream.

The extracter 240 receives the 3D audio signal and the spatial parameter from the decoder 220, and extracts the 3D object signal from the 3D audio signal by using the spatial parameter. The spatial parameter indicates a correlation between the 3D audio signal mixed with the 3D object signal and the 3D object signal, and thus the spatial parameter may be used to extract the 3D object signal from the 3D audio signal.

The renderer 230 mixes and outputs the 3D object signal and the 3D audio signal based on the location parameter received from the decoder 220.

In a case where the decoding apparatus includes a second multi-channel speaker different from a first multi-channel speaker, the renderer 230 may reset a gain value of the 3D object signal for each channel based on the location parameter according to the second multi-channel speaker.

For example, in a case where an engineer pans the 3D object signal into a 5.1 channel, and the decoding apparatus includes a 4.1 channel speaker or a 4.2 channel speaker other than a 5.1 channel speaker, the renderer 230 maps a virtual location of the 3D object signal on a 5.1 channel speaker layout onto a 4.1 channel speaker layout or a 4.2 channel speaker layout to reset the gain value of the 3D object signal for each channel. Accordingly, a 3D effect applied to the 5.1 channel 3D object signal may be precisely implemented in channels other than the 5.1 channel.

Also, the decoding apparatus according to another exemplary embodiment may allow a listener who listens to a 3D audio signal to adjust a cubic effect applied to a 3D object signal. More specifically, the renderer 230 may reset a gain value of the 3D object signal for each channel with respect to a second multi-channel according to a virtual location of the 3D object signal or the gain value of the 3D object signal for each channel received from a user. That is, in a case where the user allows the 3D object signal to be output at a specific point on a second multi-channel speaker layout, the renderer 230 resets the gain value of the 3D object signal for each channel so that the 3D object signal may be output at the corresponding point.

Figure 12:
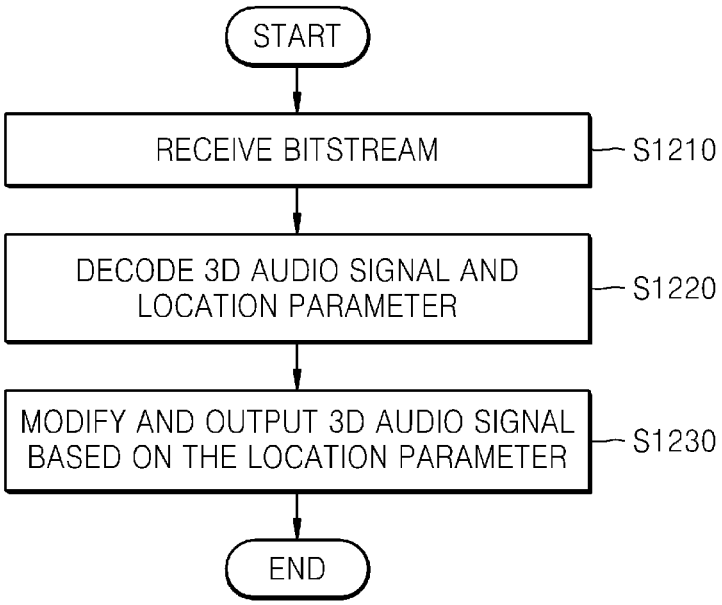
FIG. 12 is a flowchart of a decoding method according to an exemplary embodiment.

FIG. 12 is a flowchart of a decoding method according to an exemplary embodiment.

Referring to FIG. 12, in operation S1210, a decoding apparatus may receive a first bitstream including a multi-channel 3D audio signal and a second bitstream including a location parameter indicating a virtual location of a 3D object signal on a first multi-channel speaker layout.

In operation S1220, the decoding apparatus decodes the 3D audio signal from the first bitstream and decodes the location parameter from the second bitstream.

In operation S1230, the decoding apparatus modifies and outputs the 3D audio signal based on the location parameter.

The exemplary embodiments may be written as computer programs and may be implemented in general-use digital computers that execute the programs using a computer readable recording medium. Examples of the computer readable recording medium include magnetic storage media (e.g., ROM, floppy disks, hard disks, etc.), and storage media such as optical recording media (e.g., CD-ROMs, or DVDs).

While the application has been particularly shown and described with reference to exemplary embodiments thereof, it will be understood by those of ordinary skill in the art that various changes in form and details may be made therein without departing from the spirit and scope of the exemplary embodiments as defined by the following claims.

What is claimed is:

1. A method of audio rendering three-dimensional (3D) audio signals, the method comprising:

receiving an audio signal of an object and multichannel audio signals including a height channel signal;

receiving location information of the object, wherein the location information comprises height information;

obtaining first gains for the multichannel audio signals based on a first layout which is formed by the multichannel audio signals and a second layout which is formed by a plurality of output channel signals;

obtaining second gains for the audio signal of the object based on the location information of the object and the second layout;

rendering the multichannel audio signals to provide a plurality of audio-channel signals representing 3D sound over the second layout based on the first gains;

rendering the audio signal of the object to provide a plurality of object-channel signals representing 3D sound over the second layout based on the second gains; and generating the plurality of output channel signals by mixing the plurality of audio-channel signals and the plurality of object-channel signals, wherein the first layout and the second layout are independent of each other.

2. The method of claim 1, wherein a number of channels included in the first layout and a number of channels included in the second layout are independent of each other.

3. The method of claim 1, wherein the location information further comprises at least one of distance and azimuth information of the audio signal of the object.

4. The method of claim 1, further comprising:

obtaining a spatial parameter indicating a correlation between the multichannel audio signals and the audio signal of the object.

* * * * *